US005712026A

United States Patent [19]

Amagai et al.

[11] Patent Number: 5,712,026

[45] Date of Patent: Jan. 27, 1998

[54] IMAGE-RECEIVING SHEET FOR MELT THERMAL TRANSFER RECORDING

[75] Inventors: Hironobu Amagai; Takatoshi Nishizawa; Motoshi Henbo, all of Ibaraki, Japan

[73] Assignee: Oji-Yuka Synthetic Paper Co., Ltd., Tokyo, Japan

[21] Appl. No.: 694,113

[22] Filed: Aug. 8, 1996

[30] Foreign Application Priority Data

Sep. 12, 1995 [JP] Japan ..... 7-234172

[51] Int. Cl.[6] ..... B41M 5/38

[52] U.S. Cl. ..... 428/212; 427/152; 428/195; 428/206; 428/211; 428/304.4; 428/330; 428/513; 428/517; 428/910; 428/913; 428/914; 503/227

[58] Field of Search ..... 427/152; 428/195, 428/206, 211, 212, 304.4, 330, 513, 517, 910, 913, 914; 503/227

[56] References Cited

U.S. PATENT DOCUMENTS

| | | | |
|---|---|---|---|
| 4,091,165 | 5/1978 | Hayama | 428/409 |
| 4,420,539 | 12/1983 | Kostikov et al. | 428/450 |
| 4,906,526 | 3/1990 | Inoue et al. | 428/473.5 |
| 5,196,391 | 3/1993 | Ohno et al. | 503/200 |
| 5,306,690 | 4/1994 | Ohno et al. | 503/227 |

*Primary Examiner*—Bruce H. Hess
*Attorney, Agent, or Firm*—Sughrue, Mion, Zinn, Macpeak & Seas, PLLC

[57] ABSTRACT

An image-receiving sheet for melt thermal transfer recording is disclosed, including: a support (I) comprising (i) a substrate layer (A) made of a stretched film having microvoids formed therein, said stretched film of substrate layer (A) is obtained by stretching a propylene resin film comprising a propylene resin in an amount of from 65 to 95% by weight and inorganic fine powder having a specific surface area of from 10,000 to 40,000 $cm^2/g$ and an average grain diameter of from 0.5 to 2.3 μm in an amount of from 5 to 35% by weight, (ii) a surface layer (B) made of a stretched propylene film comprising a propylene resin in an amount of from 35 to 65% by weight and inorganic fine powder having a specific surface area of from 25,000 to 300,000 $cm^2/g$ and an average grain diameter of from 0.07 to 0.9 μm in an amount of from 35 to 65% by weight laminated on one side of said substrate layer (A) and (iii) a back surface layer (C) made of a stretched propylene film comprising a propylene resin in an amount of from 35 to 90% by weight and inorganic fine powder having a specific surface area of from 10,000 to 40,000 $cm^2/g$ and an average grain diameter of from 0.5 to 2.3 μm in an amount of from 10 to 65% by weight laminated on the opposite side of said substrate layer (A); a water-soluble primer layer (IIa, IIb) coated on the surface layer (B) side of the support (I) or on both sides of the support (I), and a pulp paper layer (IV) having a thickness of from 40 to 250 μm and a Taber stiffness of from 1 to 60 g·f·cm laminated on the back surface layer (C) side of the support (I) via an adhesive layer (III).

21 Claims, 1 Drawing Sheet

IMAGE-RECEIVING SHEET FOR MELT THERMAL TRANSFER RECORDING

FIELD OF THE INVENTION

The present invention relates to an image-receiving sheet for melt thermal transfer recording which provides improved ink receptivity and a sharp transfer image. The inventive image-receiving sheet is obtained by a process which comprises laminating a pulp paper on a resin film having microvoids formed therein. The resin film is obtained by stretching a polyolefin resin film containing inorganic fine powder.

BACKGROUND OF THE INVENTION

Thermal transfer recording processes can be classified into two processes, namely, a sublimation transfer process and a melt transfer process.

In the melt thermal transfer process, a thermal transfer ink ribbon 1 consisting of a hot-melt ink I and a substrate 1*b* carrying said hot-melt ink 1*a* and a thermal transfer image-receiving sheet 2 are clamped by a printing head 3 equipped with a thermal head 3*a* as a heat source and a drum 4 as shown in FIG. 2. In operation, the thermal head 3*a* is controlled by an electric signal to heat the hot-melt ink 1*a* in the thermal transfer ink ribbon 1 so that the ink 1*c* thus melted is directly transferred to the thermal transfer image-receiving recording sheet 2 as shown in FIG. 3.

In such a melt transfer process, a support layer (I) alone may be used as the thermal transfer image-receiving recording sheet 2. In most cases, however, a layer or primer layer of polyester resin or epoxy resin having good adhesion to the hot-melt ink 1*a* is provided on the surface of the support layer (I).

Accordingly, the support layer (I) of the thermal transfer image-receiving recording sheet 2 is normally made of a pulp paper, an opaque synthetic paper comprising a stretched propylene resin film having inorganic fine powder such as calcined clay and calcium carbonate incorporated therein, a transparent stretched polyethylene terephthalate film, or a coated synthetic paper having enhanced whiteness and dyability obtained by applying a pigment coating agent containing inorganic fine powder such as silica and calcium carbonate and a binder.

In view of strength and dimensional stability after thermal transfer, the support layer (I) of the thermal transfer image-receiving recording sheet 2 is said to preferably comprise a synthetic paper having numerous microvoids formed therein, obtained by stretching an inorganic fine powder-containing polyolefin resin film, as reported in JP-A-60-245593 (The term "JP-A" as used herein means an "unexamined published Japanese patent application"), JP-A-61-112693, JP-A-63-193836, JP-A-63-222891, JP-A-1-115687, JP-A-3-216386 and JP-A-5-3057800.

The above-described synthetic paper has microvoids formed therein to provide good opacity, flexibility and insulation effectiveness. This results in high heat energy efficiency and good cushioning action with respect to the printing head.

If the thermal transfer image-receiving sheet 2 for use in the foregoing melt thermal transfer process comprises the above-described stretched inorganic fine powder-containing polyolefin resin film as the support layer (I) and a water-soluble primer of a nitrogen-containing high molecular compound as the image-receiving layer (II), the primer layer, which is hygroscopic, absorbs a considerable amount of water under conditions of high temperature and humidity, thereby preventing transfer of the hot-melt ink. That is, the hot-melt ink 1*b* is hardly transferred to the image-receiving recording sheet 2. As a result, a line image such as a bar code is misprinted or a blurred image is obtained.

In view of the above difficulties, the use of a certain melt thermal transfer image-receiving recording sheet 2 has been proposed. This sheet is obtained by applying a water-soluble primer of a nitrogen-containing high molecular compound to a microporous support layer (I) made of a stretched polyolefin resin film comprising inorganic fine powder. The inorganic fine powder comprising colloidal calcium carbonate fine powder having an average grain diameter of from 0.02 to 0.5 μm and a specific surface area of from 60,000 to 300,000 $cm^2/g$ is incorporated in an amount of from 30 to 65% by weight. This image-receiving sheet is said to provide a sharp thermal transfer image even under conditions of high temperature and humidity (JP-A-6-21571).

However, if the thermal transfer recording image-receiving sheet 2 for use in a melt thermal transfer process comprises a synthetic paper made of polyolefin resin as the support (I) and a water-soluble primer of a nitrogen-containing high molecular compound as the image-receiving layer (II), the primer layer (IIa) which acts as a transferring surface (printing surface) for the hot-melt ink 1*b* exhibits high hygroscopicity and keeps evaporated water on the surface thereof under conditions of high temperature and humidity, particularly in the summer season.

Consequently, water that is evaporated from the primer layer (IIa) heated by the heat source during the melt thermal transfer printing interferes with transfer of the hot-melt ink. This in turn gives rise to poor ink transfer that causes a break in line images such as a bar code or blurs letter images to the extent that they can hardly be read by an optical reader. This also gives rise to poor ink fixing properties such that the printed image is easily blurred by rubbing with a finger.

SUMMARY OF THE INVENTION

It is therefore an object of the present invention to provide a thermal transfer recording image-receiving sheet for use in a melt transfer process which provides good ink fixing properties even under conditions of high temperature and humidity.

The present inventors extensively studied the above-described problems of the prior art. As a result, the present inventors discovered that laminating a pulp paper on the back side of the support layer (I) of the thermal transfer recording image-receiving sheet 2 enhances adhesion between the ink ribbon and the support layer (I) and also increases the stiffness of the support layer (I), to thereby prevent an air gap from forming between the ink ribbon and the support layer (I). Thus, even a support layer (I) comprising inorganic fine powder having a relatively small specific surface area exhibits further improvement in receptivity and transferability of the hot-melt ink by laminating a pulp paper on the back side of the support (I). This makes it possible to provide a sharp transferred image even under high temperature and humidity conditions, which conditions can easily cause the ink to run. The present invention has been achieved based on the above findings.

The image-receiving sheet 2 for melt thermal transfer recording according to the present invention can be prepared by a process which comprises providing a support (I) comprising (i) a substrate layer (A) made of a stretched film having microvoids formed therein, said stretched film is prepared by stretching a propylene resin film comprising a propylene resin in an amount of from 65 to 95% by weight and inorganic fine powder having a specific surface area of from 10,000 to 40,000 $cm^2/g$ and an average grain diameter of from 0.5 to 2.3 μm in an amount of from 5 to 35% by weight, (ii) a surface layer (B) made of a stretched propylene film comprising a propylene resin in an amount of from 35 to 65% by weight and inorganic fine powder having a specific surface area of from 25,000 to 300,000 $cm^2/g$ and an average grain diameter of from 0.07 to 0.9 μm in an amount of from 35 to 65% by weight laminated on one side of said substrate layer (A) and (iii) a back surface layer (C) made of a stretched propylene film comprising a propylene resin in an amount of from 35 to 90% by weight and inorganic fine powder having a specific surface area of from 10,000 to 40,000 $cm^2/g$ and an average grain diameter of from 0.5 to 2.3 μm in an amount of from 10 to 65% by weight laminated on the opposite side of said substrate layer (A), applying an aqueous solution of a nitrogen-containing high molecular compound primer on the surface layer (B) side or on both sides of support (I), drying the applied material to form one or more primer layers (IIa, IIb), and then laminating a pulp paper layer (IV) having a thickness of from 40 to 250 μm and a Taber stiffness of from 1 to 60 g·f·cm on the back surface layer (C) side of the support (I) via an adhesive layer (III), wherein the nitrogen-containing high molecular compound primer comprises (a) a tertiary or quaternary nitrogen-containing acryl polymer;

(b) a polyimine compound selected from the group consisting of polyethyleneimine, poly(ethyleneimine-urea), ethyleneimine adduct of polyamine polyamide, and alkyl modification, alkenyl modification, benzyl modification or alicyclic hydrocarbon modification products thereof in an amount of from 20 to 300 parts by weight per 100 parts by weight of (a); and (c) an epichlorohydrin adduct of polyamine polyamide in an amount of from 20 to 300 parts by weight per 100 parts by weight of (a).

DESCRIPTION OF REFERENCE NUMERALS

Figure 1:
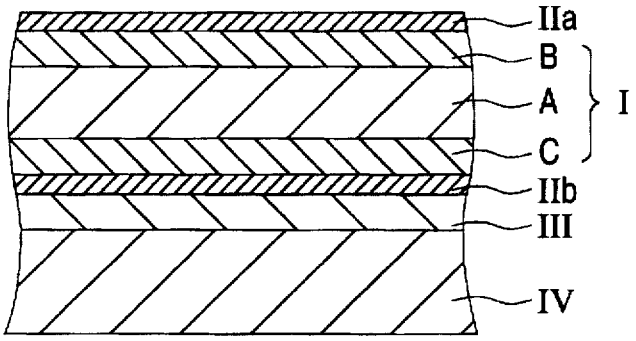
FIG. 1 is a sectional view of an image-receiving sheet for melt thermal transfer recording according to the present invention.
Figure 2:
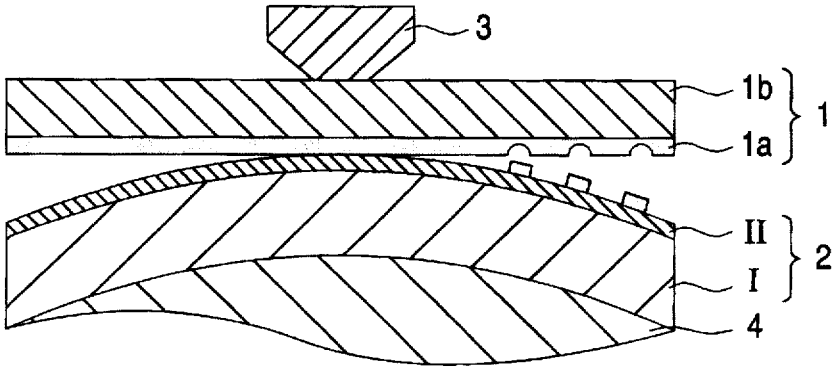
FIG. 2 is a schematic sectional view of a printer for a sublimation type thermal transfer process.
Figure 3:
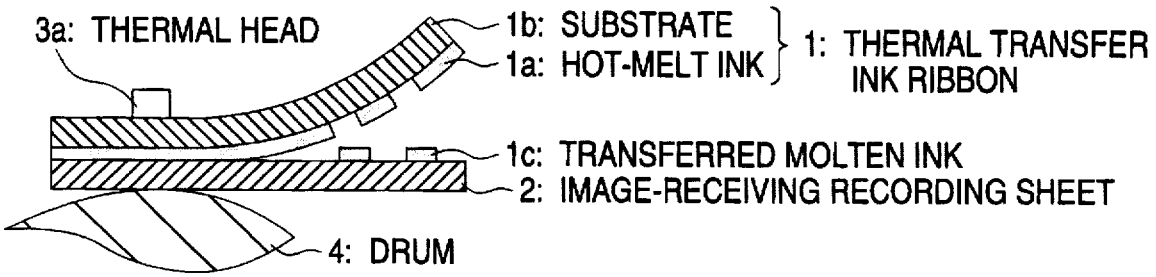
FIG. 3 is a schematic sectional view of a printer for a melt thermal transfer process.

1. Thermal transfer ink ribbon
1*a* Hot-melt ink
1*b* Substrate
1*c* Transferred molten ink
2. Image-receiving recording sheet
I Support
A Substrate layer
B Surface layer
C Back surface layer
II Thermal transfer image-receiving layer
IIa, IIb Primer layers
III Adhesive layer
IV Pulp paper layer
3 Printing head
3*a* Thermal head
4 Drum

DETAILED DESCRIPTION OF THE INVENTION

I. Support layer (I)

(1) Layer constitution

The support (I) of the image-receiving sheet 2 for melt thermal transfer recording according to the present invention is a microporous stretched resin film comprising (i) a substrate layer (A) made of a stretched film having numerous microvoids formed therein, said stretched film is prepared by stretching a propylene resin film comprising a propylene resin in an amount of from 65 to 95% by weight and inorganic fine powder having a specific surface area of from 10,000 to 40,000 $cm^2/g$ and an average grain diameter of from 0.5 to 2.3 μm in an amount of from 5 to 35% by weight, (ii) a surface layer (B), which is the surface to which the hot-melt ink is transferred (printing surface), made of a stretched propylene film comprising a propylene resin in an amount of from 35 to 65% by weight and inorganic fine powder having a specific surface area of from 25,000 to 300,000 $cm^2/g$ and an average grain diameter of from 0.07 to 0.9 μm in an amount of from 35 to 65% by weight laminated on one side of said substrate layer (A), and (iii) a back surface layer (C) made of a stretched propylene film comprising a propylene resin in an amount of from 35 to 90% by weight and inorganic fine powder having a specific surface area of from 10,000 to 40,000 $cm^2/g$ and an average grain diameter of from 0.5 to 2.3 μm in an amount of from 10 to 65% by weight laminated on the opposite side of said substrate layer (A).

(a) Substrate layer (A)

Constitution

The substrate layer (A) made of a stretched film having numerous microvoids formed therein is a stretched propylene resin film obtained by a process which comprises forming a propylene resin composition (A) into a film, said composition (A) comprising a propylene resin in an amount of from 65 to 95% by weight, preferably from 75 to 95% by weight, particularly from 80 to 95% by weight, and inorganic fine powder having a specific surface area of from 10,000 to 40,000 $cm^2/g$, preferably from 15,000 to 30,000 $cm^2/g$, particularly from 15,000 to 28,000 $cm^2/g$ in an amount of from 5 to 35% by weight, preferably from 5 to 25% by weight, particularly from 5 to 20% by weight, and then biaxially stretching the film.

Properties

The substrate layer (A) is made of a stretched film having numerous oval microvoids having a size of from 3 to 20 μm formed therein. The microvoids enhance opacity and whiteness. The stretching enhances strength such as tensile strength.

(b) Surface layer (B)

Constitution

The surface layer (B) made of a stretched propylene resin film is a stretched propylene resin film obtained by a process which comprises forming a propylene resin composition (B) into a film, said resin composition (B) comprising a propylene resin in an amount of from 35 to 65% by weight, preferably from 40 to 55% by weight, and inorganic fine powder having a specific surface area of from 25,000 to 300,000 $cm^2/g$, preferably from 40,000 to 300,000 $cm^2/g$ from the standpoint of ink transferability and printing speed or from 30,000 to 45,000 $cm^2/g$ from the standpoint of ink dryability and opacity of support, in an amount of from 35 to 65% by weight, preferably from 45 to 60% by weight, and then uniaxially or biaxially stretching the film.

Properties

The surface layer (B) comprises inorganic fine powder incorporated therein in a relatively large amount. Furthermore, the surface layer (B) has a roughened surface imparted by the stretching to provide enhanced affinity for the ink. Thus, the transferability of hot-melt ink is improved, to thereby provide appropriate properties as a printing surface.

Furthermore, the microvoids enhance opacity and whiteness. The stretching enhances strength such as tensile strength and flexural strength.

(c) Back surface layer (C)

Constitution

The back surface layer (C) made of a stretched propylene resin film is a stretched propylene resin film obtained by a process which comprises forming a propylene resin composition (C) into a film, said resin composition (C) comprising a propylene resin in an amount of from 35 to 90% by weight, preferably from 55 to 85% by weight, and inorganic fine powder having a specific surface area of from 10,000 to 40,000 $cm^2/g$, preferably from 12,000 to 35,000 $cm^2/g$ from the standpoint of writing properties, in an amount of from 10 to 65% by weight, preferably from 15 to 45% by weight, and then uniaxially or biaxially stretching the film.

Properties

The back surface layer (C) is made of a stretched film having numerous microvoids formed therein. The microvoids enhance opacity and whiteness. The stretching enhances strength such as tensile strength.

(2) Lamination (formation of support layer (I))

Formation of stretched film

Propylene resin compositions (A), (B) and (C) comprising the foregoing inorganic fine powder in various concentrations are melted and kneaded through separate extruders, and then subjected to film formation by an inflation method, a T-die method, etc. to produce propylene resin films. Each of the films is then stretched at least uniaxially at a temperature lower than the melting point of the respective propylene resins to form opaque resin films.

Lamination

The lamination may be conducted either before or after the stretching. Alternatively, the stretching of one layer may be followed by lamination of another layer. The laminate may then be stretched again in a direction which is at a right angle to the foregoing stretching. In this manner, for example, a synthetic paper made of a laminated resin film comprising a biaxially-stretched substrate layer (A) and uniaxially-stretched surface layers (B) and (C) may be formed.

The foregoing stretching may be conducted uniaxially in the machine direction or the transverse direction, or biaxially in the machine direction and the transverse direction by means of a tenter, mandrel, roll or the like.

(3) Material (a) Propylene resin

The propylene resin for use as a starting material of the propylene resin compositions (A), (B) and (C) constituting the foregoing substrate layer (A), surface layer (B) and back surface layer (C) may be a propylene homopolymer or a propylene-α-olefin copolymer obtained by copolymerizing propylene as a main component with a small amount of an α-olefin such as ethylene, butene-1, hexene-1, heptene-1 and 4-methylpentene-1.

This propylene-α-olefin copolymer may be a random copolymer or a block copolymer. The propylene-α-olefin copolymer preferably has a melt flow rate (JIS K-7210; 230° C., 2.16 kg load) of from 0.5 to 50 g/10 min., more preferably from 0.8 to 15 g/10 min., particularly from 1 to 12 g/10 min., a crystallinity (X-ray method) of not less than 20%, particularly from 40 to 75%, and a melting point of from 140° to 190° C., more preferably from 164° to 180° C.

(b) Inorganic fine powder

The inorganic fine powder for use as a starting material of the propylene resin compositions (A), (B) and (C) constituting the foregoing substrate layer (A), surface layer (B) and back surface layer (C) may be calcium carbonate, heavy calcium carbonate, colloidal calcium carbonate, calcined clay, diatomaceous earth, talc, titanium dioxide, barium sulfate, aluminum sulfate, silica and mixtures thereof.

Among these inorganic fine powders, heavy calcium carbonate having a specific surface area of from 35,000 to 45,000 $cm^2/g$ or colloidal calcium carbonate having a specific surface area of not less than 60,000 $cm^2/g$ is preferably incorporated into the surface layer of the support. Colloidal calcium carbonate is particularly preferred.

The foregoing heavy calcium carbonate includes calcium carbonate obtained by finely crushing limestone by a hammer mill or the like, and then classifying and sifting the material.

The colloidal calcium carbonate includes calcium carbonate crystal produced by blowing carbon dioxide gas into a milk of lime obtained by hydrating quick lime, and a product obtained by recovering and drying calcium carbonate crystal produced by the reaction of soda ash with calcium chloride.

The foregoing colloidal calcium carbonate has a grain diameter of not more than 0.5 μm, preferably from 0.02 to 0.2 μm, and a specific surface area (BET method) of from 60,000 to 300,000 $cm^2/g$, particularly from 100,000 to 250,000 $cm^2/g$. The colloidal calcium carbonate is commercially available from Shiraishi Kogyo K.K. in the name of Brilliant 15 (trade name) and from Maruo Calcium K.K. in the name of MSK-PO or Calfine 100 (trade name).

If the grain diameter of colloidal calcium carbonate exceeds 0.5 μm, the resulting support (I) has an increased surface roughness that reduces printing speed. Furthermore, a large grain diameter makes it impossible to increase the specific surface area to not less than 60,000 $cm^2/g$. In this case, the calcium carbonate cannot thoroughly absorb water which has been absorbed by the primer layer. This can deteriorate the quality of the printed image.

In accordance with state-of-the-art techniques for producing colloidal calcium carbonate, those having a grain diameter of less than 0.02 μm or a specific surface area (BET method) of more than 300,000 $cm^2/g$ cannot be obtained.

Specific surface area

As the methods for measuring the specific surface area are known Langmuir method and air permeability method as well as BET method (see Kiichiro Kubo et al., Funtai (powder), pp. 132–165, published by Maruzen Co., Ltd., (1970)). Because the data obtained in one of these methods agree very closely with those obtained in another thereof, the air permeability method which is easy in the measuring operation as compared with the others was used in the examples in the specification of the present invention.

With regard to machines for measuring the physical properties of inorganic fine powder, a constant pressure ventilation type specific surface area measuring instrument "SS-100" (trade name) available from Shimadzu Corp. may be used for measuring the specific surface area by air permeability method.

A laser diffraction type grain diameter measuring instrument called "Microtrac" available from Leeds & Northrup Co., Ltd. may be used to measure the average grain diameter. The average grain diameter is represented by a value corresponding to 50% of total weight.

(c) Optional components

Optional components other than the foregoing propylene resin and inorganic fine powder may be blended into the starting materials of the foregoing propylene resin compositions (A), (B) and (C), so long as the objects of the present invention are achieved.

Specific examples of these optional components include a stabilizer, an ultraviolet absorber, an oxidation inhibitor, a lubricant and a dispersant. If necessary, a portion of the propylene resin may be replaced by high density polyethylene, a high density branched polyethylene or the like in a proportion of not more than 30% by weight.

The inorganic fine powder may optionally comprise titanium dioxide having a grain diameter of from 0.3 to 1.5 μm in an amount of from 0.5 to 8% by weight to enhance weathering resistance or whiteness of the layer.

(4) Properties of support layer (I)

The support (I) has microvoids formed therein. The content of the microvoids is from 20 to 60%, preferably from 25 to 50%, calculated in terms of void % by the following equation:

$$\text{Void \%} = \frac{\text{Density of unstretched film} - \text{Density of stretched film having voids}}{\text{Density of unstretched film}} \times 100$$

If the foregoing void % is less than 20%, the support (I) is not sufficiently opaque. On the contrary, if the void % exceeds 60%, the support (I) becomes limp, thereby reducing label formation or printing efficiency.

The support (I) has an opacity (JIS P-8138) of not less than 85%, preferably from 90 to 100%, a whiteness (JIS L-1015) of from 80 to 100%, a Bekk smoothness (JIS P-8119) of from 550 to 30,000 seconds, preferably from 1,000 to 3,000 seconds, on the side thereof to which the ink is transferred, a central line average roughness (JIS B-0601-1982) of not more than 0.5 μm, preferably from 0.1 to 0.45 μm, and a thickness of from 40 to 300 μm, preferably from 60 to 200 μm.

The thickness of the substrate layer (A) of the support (I) is from 5 to 50 μm, the thickness of the surface layer (B) of the support (I) is from 30 to 200 μm, the thickness of the back surface layer (C) of the support (I) is from 5 to 50 μm.

If the opacity of the support (I) is less than 80%, the background such as a drum can, gas cylinder and steel plate to which a management label is applied is seen through the label when a bar code on the label is read. This lowers the contrast between the printed black bar code and the white background, and hence causes an error in reading the bar code. II. Primer layers (IIa), (IIb)

(1) Layer structure

A nitrogen-containing high molecular compound primer layer (IIa) is formed on the surface layer (B) of the support (I) to enhance the antistatic properties of the support and to form a thermal transfer image-receiving layer (II) which improves receptivity of the hot-melt ink.

A nitrogen-containing high molecular compound primer layer (IIb) is formed on the back surface layer (C) of the support (I) for adhering a pulp paper layer (IV) via adhesive layer (III).

(2) Constitution

The water-soluble nitrogen-containing high molecular compound primer constituting the nitrogen-containing high molecular compound primer layers (IIa, IIb) is obtained by blending the following components (a), (b) and (c) in the following proportion:

(a) a tertiary or quaternary nitrogen-containing acryl polymer (100 parts by weight);

(b) a polyimine compound selected from the group consisting of polyethyleneimine, poly(ethyleneimine-urea), ethyleneimine adduct of polyamine polyamide, and alkyl modification, alkenyl modification, benzyl modification or alicyclic hydrocarbon modification product thereof (20 to 300 parts by weight); and (c) an epichlorohydrin adduct of polyamine polyamide (20 to 300 parts by weight).

(3) Constituent material (a) Tertiary or quaternary nitrogen-containing acryl polymer—Component (a)

An example of the tertiary or quaternary nitrogen-containing acryl polymer—Component (a) is a copolymer of the following components (1) to (3):

Component (1): at least one monomer selected from the group consisting of compounds represented by the following chemical formula (I), (II), (III), (IV), (V), (VI) or (VII) in an amount of from 4 to 94% by weight.

Chemical formula (I):

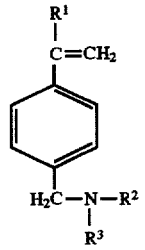

(I)

Chemical formula (II):

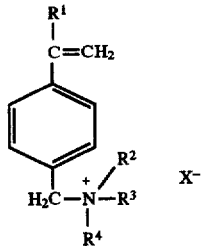

(II)

Chemical formula (III):

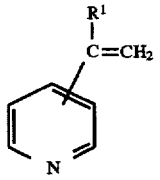

(III)

Chemical formula (IV):

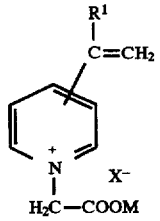

(IV)

-continued

Chemical formula (V):

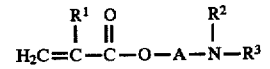

(V)

Chemical formula (VI):

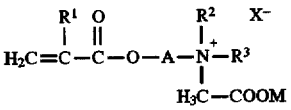

(VI)

Chemical formula (VII):

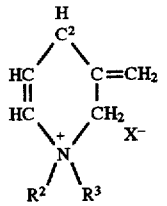

(VII)

wherein $R^1$ represents a hydrogen atom or a methyl group; $R^2$ and $R^3$ each represents a lower alkyl group (preferably having from 1 to 4 carbon atoms, particularly 1 or 2 carbon atoms); $R^4$ represents a $C_{1-22}$ saturated or unsaturated alkyl group or a $C_{5-15}$ cycloalkyl group; $X^-$ represents a counter anion of a quaterized $N^+$ (e.g., halide, particularly chloride); M represents an alkaline metal ion (e.g., sodium, potassium); and A represents a $C_{2-6}$ alkylene group.

Preferred among these monomers is the compound represented by chemical formula (VI).

Component (2): Ester (meth)acrylate in an amount of from 6 to 80% by weight represented by formula (VIII). Chemical formula (VIII):

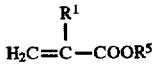

(VIII)

wherein $R^1$ represents a hydrogen atom or a methyl group; and $R^5$ represents a $C_{1-24}$ alkyl, alkylene or cycloalkyl group.

Specific examples of the ester (meth)acrylate include butyl acrylate, capryl acrylate and stearyl methacrylate.

Component (3): another hydrophobic vinyl monomer in an amount of from 0 to 20% by weight.

Specific examples of the hydrophobic vinyl monomer include styrene and vinyl chloride.

Among the tertiary or quaternary nitrogen-containing acryl polymers represented by component (a), the water-soluble polymer which exhibits the most preferred antistatic properties is one comprising as a monomer the component (1) represented by the chemical formula (VI) wherein $X^-$ is $Cl^-$. This compound is commercially available from Mitsubishi Chemical Corporation under the trade names of "Saftomer ST-1000", "Saftomer ST-1100", "Saftomer ST-1300" and "Saftomer ST-3200".

(b) Polyimine compound—Component (b)

Examples of the polyimine compound (b) include polyethyleneimine having a polymerization degree of from 200 to 3,000, poly(ethylene-urea), polyaminepolyamide ethyleneimine compound, and modified polyethyleneimine represented by the following formula (IX):

Chemical formula (IX):

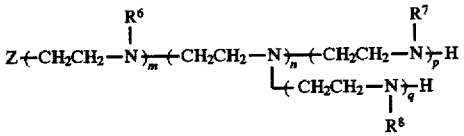

(IX)

wherein Z represents a group represented by the following chemical formula (X):

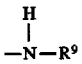

(X)

or polyamine polyamide residue; $R^6$ to $R^9$ each independently represents a hydrogen atom, a $C_{1-24}$ alkyl group, a cycloalkyl group or a benzyl group, with the proviso that at least one of $R^6$ to $R^9$ represents a group other than a hydrogen atom; m represents 0 or an integer of from 1 to 300; and n, p and q each represents an integer of from 1 to 300. The polyimine compound is described in U.S. Pat. No. 4,906,526 incorporated herein by reference.

This modified polyethyleneimine is a product of a polyethyleneimine or polyethyleneimine adduct of polyamine-polyamide which has been modified with a halide such as the $C_{1-24}$ halogenated alkyl, halogenated alkenyl, halogenated cycloalkyl or halogenated benzyl for $R^6$ to $R^9$.

(c) Polyamide epichlorohydrin adduct of polyamine polyamide—Component (c)

An example of the polyamide epichlorohydrin adduct of polyamine polyamide used as the component (c) is a water-soluble cationic thermosetting resin obtained by a process which comprises reacting a $C_{3-10}$ saturated dibasic carboxylic acid with a polyalkylene polyamine to produce a polyamide which is then reacted with epichlorohydrin. This thermosetting resin is further described in JP-B-35-3547 (The term "JP-B" as used herein means an "examined Japanese patent publication").

Specific examples of the foregoing $C_{3-10}$ saturated dibasic carboxylic acid include $C_{4-8}$ dicarboxylic acids such as adipic acid.

Specific examples of the foregoing polyalkylene polyamine include polyethylene polyamines such as ethylenediamine, diethylenetriamine and triethylenetetraamine. Particularly preferred among these polyethylene polyamines is diethylenetriamine.

(4) Mixing ratio

The primer comprises in combination the component (a) having antistatic properties, the component (b) for further enhancing adhesion and the component (c) having a crosslinking effect.

The mixing ratio (solid content) of the components (a), (b) and (c) is (a) in an amount of 100 parts by weight, (b) in an amount of 20 to 300 parts by weight, preferably 25 to 200 parts by weight, and (c) in an amount of 20 to 300 parts by weight, preferably 30 to 100 parts by weight.

If needed, a water-soluble inorganic salt such as sodium carbonate, sodium sulfate, sodium sulfite, alum and sodium polyphosphate may be incorporated into the primer in a proportion of from 5 to 20 parts by weight based on 100 parts by weight of the component (a).

The primer may further comprise a water-soluble organic solvent such as ethyl alcohol and isopropyl alcohol, a surface active agent, a water-soluble polymerizing agent such as ethylene glycol and polyvinyl alcohol, and other auxiliary materials.

The primer is normally used in the form of an aqueous solution of from 0.1 to 10% by weight, preferably from 0.1 to 5% by weight in terms of solid content.

((5) Coating (a) Coated amount

The amount of the primer that is coated on the resin film is from 0.005 to 10 g/m$^2$, preferably from 0.02 to 5 g/m$^2$in terms of solid content.

(b) Coating apparatus

A coating apparatus utilizing a roll, blade, air knife, size press or the like may be used as a primer coating apparatus.

III. Adhesive layer (III)

(1) Layer constitution

An adhesive layer (III) for adhering the pulp paper layer (IV) is formed on the surface of the nitrogen-containing high molecular compound primer layer (IIb) laminated on the back surface layer (C) of the support (I), which surface is across the primer layer (IIb) from the side of the back surface layer (C).

A known adhesive may be used as the adhesive layer (III). Specific examples thereof include casein, polyvinyl alcohol, various processed starches, polyacrylamide, carboxymethyl cellulose, methyl cellulose, rubber adhesives such as carboxy-modified styrene-butadiene latex, acrylonitrile-butadiene latex and methyl methacrylate-butadiene latex, acrylic adhesives such as acryl emulsion, silicone adhesive and vinyl adhesive.

Preferred among these adhesives is a rubber adhesive.

The adhesive layer (III) is applied in an amount of from 25 to 150 g/m$^2$, preferably from 50 to 120 g/m$^2$ in terms of solid content, to a thickness of from 20 to 140 μm, preferably from 45 to 110 μm.

Alternatively, the adhesive layer (III) may be previously formed on the pulp paper layer (IV), and then heated so that it is fused to the primer layer.

(2) Coating apparatus

The same coating apparatus as used for coating the foregoing primer may also be used to apply the adhesive layer IV. Pulp paper layer (IV)

(1) Pulp paper

The pulp paper layer (IV) is a pulp paper having a thickness of from 40 to 250 μm, preferably from 50 to 180 μm, a weight of from 40 to 220 g/m$^2$ and a Taber stiffness of from 1 to 60 g·f·cm, preferably from 1.5 to 30 g·f·cm.

The Taber stiffness of the pulp paper can be measured by means of a Taber type stiffness tester in accordance with the testing method of JIS P-8125.

Specific examples of the pulp paper include high quality paper, art paper, kraft paper, glassine paper, parchment paper, coated paper, wall paper, backing paper, synthetic resin or emulsion-impregnated paper, cardboard, silicone oil and coated release paper.

The pulp paper may be subjected to surface treatment with various sealers such as polyethylene, polyvinylidene chloride, clay-containing binder, PVA, starch and CMC, silicone or the like on one side or both sides thereof.

(2) Lamination

The pulp paper layer (IV) can be laminated on the support (I) using known methods for laminating an adhesive.

The lamination method can be selected from a wet lamination method, a dry lamination method, an extrusion lamination method, a heat-melt lamination method, and a thermal lamination method depending on the form of adhesive that is used and the coating method.

Furthermore, the kind and amount of the adhesive to be used in lamination and the lamination method is appropriately selected depending on the material of the support (I) and the pulp paper layer (IV).

V. Image-receiving sheet for melt thermal transfer recording (1) Layer constitution As shown in FIG. 1, the image-receiving sheet for melt thermal transfer recording comprises surface primer layer (IIa) onto which the hot-melt ink is transferred (printing surface). The primer layer (IIa) is formed by applying and drying an aqueous solution of a nitrogen-containing high molecular compound primer having a composition as described above. Formed below the primer layer (IIa) is a surface layer (B) made of a stretched propylene resin film comprising a propylene resin in an amount of from 35 to 65% by weight and inorganic fine powder having a specific surface area of from 25,000 to 300,000 cm$^2$/g and an average grain diameter of from 0.07 to 0.9 μm in an amount of from 35 to 65% by weight.

Formed on the surface of the surface layer (B) across the surface layer (B) from the side of the primer layer (IIa) is substrate layer (A) made of a stretched film having numerous microvoids formed therein. The substrate layer (A) is obtained by stretching a propylene resin film comprising a propylene resin in an amount of from 65 to 95% by weight and inorganic fine powder having a specific surface area of from 10,000 to 40,000 cm$^2$/g and an average grain diameter of from 0.5 to 2.3 μm in an amount of from 5 to 35% by weight.

Formed on the surface of the substrate layer (A) across the substrate layer (A) from the side of the surface layer (B) is back surface layer (C) made of a stretched propylene film comprising a propylene resin in an amount of from 35 to 90% by weight and inorganic fine powder having a specific surface area of from 10,000 to 40,000 cm$^2$/g and an average grain diameter of from 0.5 to 2.3 μm in an amount of from 10 to 65% by weight.

The surface layer (B), the substrate layer (A) and the back surface layer (C) together form the support (I).

Formed below the back surface layer (C) is primer layer (IIb) obtained by applying and drying an aqueous solution of a nitrogen-containing high molecular compound primer having the composition defined above.

Laminated on the primer layer (IIb) via adhesive layer (III) is pulp paper layer (IV) having a thickness of from 40 to 250 μm, a weight of from 40 to 220 g/m$^2$ and a Taber stiffness of from 1 to 60 g·f·cm.

(2) Effect

The image-receiving sheet for melt thermal transfer recording 2 thus obtained is advantageous in that the inorganic fine powder incorporated into the polyolefin resin synthetic paper constituting the support (I) has a large specific surface area. Numerous microvoids which have been developed with these fine powder as nuclei upon the stretching are formed in the surface layer of the support (I). Consequently, water which evaporates from the primer layer (IIa) when heated by a heat source can escape to the inorganic fine powder and microvoids. In turn, transfer of the hot-melt ink is not inhibited even under high temperature and humidity conditions.

Furthermore, if colloidal silica having a small grain diameter is incorporated into the surface layer as the inorganic fine powder, the resulting image-receiving sheet (II) has a smooth surface which provides good adhesion to the ink ribbon and a good transferability, thereby enabling high speed printing.

Moreover, laminating a pulp paper layer (IV) onto the back side of the support (I) enhances adhesion of the ink ribbon 1 to the image-receiving sheet for melt thermal transfer recording 2 and also stiffens the support, to thereby prevent an air gap from forming between the ink ribbon 1 and the image-receiving sheet for melt thermal transfer recording 2. Accordingly, even a support (I) comprising inorganic fine powder having a relatively small specific surface area exhibits further improvement in receptivity and transferability of the hot-melt ink by laminating a pulp paper on the back side of the support (I). This makes it possible to provide a sharp transferred image even under high temperature and humidity conditions.

Further, if heavy calcium carbonate is used as the inorganic fine powder, excellent cost merit and good ink transfer density without color fading can be obtained.

Moreover, if colloidal calcium carbonate is used as the inorganic fine powder, improved hot-melt ink transferability and a higher surface strength as compared with heavy calcium carbonate can be obtained.

The present invention will be further described in the following Examples and Comparative Examples. However, the present invention should not be construed as being limited thereto.

EXAMPLE 1

Preparation of support layer (1) A composition (A) obtained by mixing 81 wt % polypropylene (melting point: about 164° to 167° C.) having a melt flow rate (MFR) of 0.8 g/10 min., 3 wt % high density polyethylene and 16 wt % calcium carbonate having an average grain diameter of 1.5 μm and a specific surface area of 15,000 $cm^2/g$ was kneaded and extruded through an extruder maintained kept at a temperature of 270° C. to form a sheet which was then cooled by a cooling apparatus to obtain an unstretched sheet. The sheet was heated to a temperature of 150° C., and then stretched by a factor of 5 in the machine direction to obtain a five-fold machine-directionally stretched resin film.

(2) A composition (B) obtained by mixing 50 wt % a polypropylene (melting point: about 164° to 167° C.) having a melt flow rate (MFR) of 0.3 g/10 min. and 50 wt % colloidal calcium carbonate having an average grain diameter of 0.15 μm and a specific surface area of 115,000 $cm^2/g$ was kneaded by another extruder maintained at a temperature of 210° C., and then extruded through a die to form a sheet. The sheet thus obtained was then laminated on one side of the five-fold machine-directionally stretched film obtained in the foregoing step (1) to obtain a double structure laminated film.

(3) A composition (C) having the same composition as the foregoing composition (A) was kneaded by another extruder maintained at a temperature of 210° C., and then extruded through a die to form a sheet. The sheet thus obtained was then laminated on the other (opposite) side of the five-fold machine-directionally stretched film obtained in the foregoing step (1) to obtain a three-layer structure laminated film.

Subsequently, the three-layer structure laminated film was cooled to a temperature of 60° C., and then heated to a temperature of 155° C. The film heated to a temperature of 155° C. was then stretched by a factor of 7.5 in the transverse direction by means of a tenter. The film thus stretched was annealed at a temperature of 165° C., and then cooled to a temperature of 60° C. at which point the both surfaces of the film were then subjected to corona discharge. The film thus treated was then slit at its edge to obtain a three-layer (uniaxially-stretched layer/biaxially-stretched layer/uniaxially-stretched layer) stretched laminated resin film having a thickness of 80 μm (B/A/C=20 μm/40 μm/20 μm), a whiteness of 96%, an opacity of 90%, a void content of 33%, a smoothness of 2,000 sec. (layer B) and a gloss of 92% (layer B). This film was used as a support.

Formation of primer layer

A compound having a molecular chain represented by the following chemical formula (XI) was selected for use as component (a) of the nitrogen-containing acryl polymer. Chemical formula (XI)

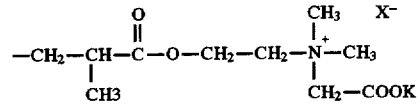

(XI)

Examples of this compound include (a-1) water-soluble acryl antistatic agents "ST-3200" and "ST-1100" (trade name) available from Mitsubishi Chemical Corporation.

Examples of the polyimine compound used as the component (b) include (b-1) polyethyleneimine "Polymine SN" (trade name) available from BASF, and (b-2) butylated polyethyleneimine "Saftomer AC-72" (trade name) (available from Mitsubishi Chemical Corporation) obtained by the reaction of polyethyleneimine with butyl chloride.

The epichlorohydrin adduct of polyamine polyamide used as the component (c) was "WS-570" (trade name) available from Dainippon Ink & Chemicals, Inc.

Besides the foregoing components, sodium carbonate (inorganic salt) was used as component (d).

The foregoing components (a) to (d) were then mixed in the ratio set forth in Table 1 in terms of solid content. The mixture was then diluted with water. The composition thus obtained was applied to the supports of the various Examples, and then dried to form a primer layer on the surface of these supports.

TABLE 1

| Primer composition | | I | II | III | None |
|---|---|---|---|---|---|
| (a-1) | ST-1100 | 1.0 | — | 2.0 | — |
| (a-2) | ST-3200 | — | 0.5 | — | — |
| (b-1) | Polymine SN | 0.25 | — | — | — |
| (b-2) | Saftomer AC-72 | — | 0.5 | — | — |
| (c) | WS-570 | 0.3 | 0.4 | — | — |
| (d) | $Na_2CO_3$ | 0.15 | 0.1 | — | — |

(unit: parts by weight)

Lamination of pulp paper

Using a dry laminator as an apparatus for coating and lamination of an adhesive, a solvent-based strong adhesive (Oribine BPS-1109 (trade name), available from Toyo Ink Mfg. Co., Ltd.) was applied to a silicone oil-coated kraft paper having a thickness of 150 μm and a stiffness of 12 g·f·cm by means of a knife coater in an amount such that the solid content thereof was 25 $g/m^2$. The coated material was dried at a temperature of 95° C. in an oven, and then laminated on the support by a dry lamination method to obtain an image-receiving sheet for melt thermal transfer recording.

Evaluation

The foregoing image-receiving sheet for melt thermal transfer recording was evaluated as follows:

(1) Melt thermal transfer printing properties

Using a printer "Bar Code Printer B-30-S5" (available from Tokyo Electric Co., Ltd.) with a hot-melt type ink ribbon "Wax Type B110A" or "Resin Type B110C" (trade name) (available from Ricoh Co., Ltd.), a bar code was printed on one side of the thermal transfer image-receiving sheet in a 35° C.–85% RH constant temperature chamber.

(2) Evaluation of printing quality

The printed image was visually evaluated as follows:

| | |
|---|---|
| 5: Good | A sharp image was obtained. |
| 4: Fair | Blurred letters were observed, but a desired practical level was maintained. |
| 3: Poor | Lines in the bar code image were broken. |
| 2: Poor | Printed letters could hardly be read. |
| 1: Poor | Little or no ink was transferred. |

(3) Paper feeding and discharging properties, running properties

○: Good x: Paper did not pass through the printer.

(4) Ink transferability

A UV ink "L-Carton Black Ink" (trade name) (available from T&K TOKA) was transferred to the specimen in an amount of 1.5 g/m$^2$ by an RI transferring machine, and then dried by means of a UV emitter. The solid black density of the specimen was then measured using a Macbeth densitometer.

(5) Surface strength

The surface strength of the printing surface of the specimen was measured by means of a bond tester.

The results are set forth in Table 2.

TABLE 2

| | Support | | | | Melt thermal transfer printing | | Running properties/ paper feeding and discharging properties | | |
|---|---|---|---|---|---|---|---|---|---|
| | Inorganic fine powder | | | | | | | | |
| | Specific | | | Laminating | 35° C.-85% RH | | by thermal | Ink | |
| Example No. | surface area (cm$^2$/g) | Content (wt %) | Kind of primer | pulp paper (μm) | Wax type | Resin type | transfer printer | transf-erability | Surface strength |
| Example 1 | 115,000 | 50 | II | 150 | 5 | 5 | ○ | Good | Good |
| Compar. Example 1 | 115,000 | 50 | II | None | 3 | 3 | ○ | Good | Good |
| Compar. Example 2 | 115,000 | 50 | None | 150 | 3 | 2 | ○ | *1 | Good |
| Compar. Example 3 | 32,000 | 50 | II | 20 | 3 | 4 | ○ | Good | Good |
| Example 2 | 115,000<br>32,000 | 10<br>40 | II | 150 | 5 | 5 | ○ | Good | Good |
| Example 3 | 32,000 | 50 | II | 150 | 5 | 4 | ○ | Good | Good |
| Example 4 | 32,000 | 50 | I | 150 | 5 | 4 | ○ | Good | Good |
| Example 5 | 32,000 | 50 | II | 50 | 5 | 5 | ○ | Good | Good |
| Compar. Example 4 | 32,000 | 50 | II | None | 3 | 2 | ○ | Good | Good |
| Compar. Example 5 | 32,000 | 50 | III | 150 | 2 | 3 | ○ | *2 | Good |
| Compar. Example 6 | 32,000 | 70 | II | 150 | 3** | 5 | ○ | Good | Poor |
| Compar. Example 7 | 32,000 | 30 | II | 150 | 1 | 1 | ○ | Good | Good |
| Compar. Example 8 | 32,000 | 50 | None | 150 | 2 | 1 | ○ | *3 | Good |
| Compar. Example 9 | 32,000 | 50 | II | 300 | — | — | x | — | — |
| Compar. Example 10 | 15,000 | 50 | II | 150 | 2 | 1 | ○ | *4 | Good |

**: The material was partially caught by the ribbon on areas to which the ink had been transferred due to destruction.
*1: The ink was substantially transferred to the specimen but was not fixed thereon.
*2: Weak
*3: The ink was substantially transferred to the specimen but was not fixed thereon.
*4: Remarkably rough surface Comparative Example 1

The procedure of Example 1 was followed to obtain an image-receiving sheet for melt thermal transfer recording, except that a pulp paper was not laminated on the back surface layer (C).

Comparative Example 2

The procedure of Example 1 was followed to obtain an image-receiving sheet for melt thermal transfer recording, except that the primer layer (IIa) was not applied to the surface layer (B).

Comparative Example 3

The procedure of Example 1 was followed to obtain an image-receiving sheet for melt thermal transfer recording, except that a glassine paper having a weight of 25 g/m$^2$ (thickness: 22 μm) was used as the laminated pulp paper.

EXAMPLE 2

The procedure of Example 1 was followed, except that a composition obtained by mixing 50 wt % polypropylene, 10 wt % colloidal calcium carbonate having an average grain diameter of 0.15 μm and a specific surface area of 115,000 cm$^2$/g and 40 wt % calcium carbonate having an average grain diameter of 0.70 μm and a specific surface area of 32,000 $cm^2/g$ was used as the composition (B). As a result, a stretched laminated resin film having a whiteness of 97%, an opacity of 90%, a void content of 34%, a smoothness of 1,250 sec. (layer (B)) and a gloss of 23% (layer (B)) was obtained. An image-receiving sheet for melt thermal transfer recording was prepared from this film as a support layer.

EXAMPLE 3

The procedure of Example 1 was followed, except that a composition comprising 50 wt % polypropylene and 50 wt % calcium carbonate having an average grain diameter of 0.70 μm and a specific surface area of 32,000 $cm^2/g$ was used as the composition (B). As a result, a stretched laminated resin film having a whiteness of 97%, an opacity of 90%, a void content of 36%, a smoothness of 1,000 sec. (layer (B)) and a gloss of 15% (layer (B)) was obtained. An image-receiving sheet for melt thermal transfer recording was prepared from this film as a support layer.

EXAMPLE 4

The procedure of Example 3 was followed to obtain an image-receiving sheet for melt thermal transfer recording, except that primer composition (I) was used in place of primer composition (II) as set forth in Table 1.

EXAMPLE 5

The procedure of Example 3 was followed to obtain an image-receiving sheet for melt thermal transfer recording, except that a high quality paper having a thickness of 58 μm (Taber stiffness: 1.8 g·f·cm) was used as the laminated pulp paper.

Comparative Example 4

The procedure of Example 3 was followed to obtain an image-receiving sheet for melt thermal transfer recording, except that a pulp paper was not laminated.

Comparative Example 5

The procedure of Example 3 was followed to obtain an image-receiving sheet for melt thermal transfer recording, except that primer (IV) was used in place of primer (II).

Comparative Example 6

The procedure of Example 3 was followed, except that a composition comprising 30 wt % polypropylene and 70 wt % calcium carbonate having an average grain diameter of 0.70 μm and a specific surface area of 32,000 $cm^2/g$ was used as the composition (B). As a result, a stretched laminated resin film having a whiteness of 97%, an opacity of 94%, a void content of 42%, a smoothness of 450 sec. (layer (B)) and a gloss of 10% (layer (B)) was obtained. An image-receiving sheet for melt thermal transfer recording was prepared from this film as a support layer.

Comparative Example 7

The procedure of Example 3 was followed, except that a composition comprising 70 wt % polypropylene and 30 wt % calcium carbonate having an average grain diameter of 0.70 μm and a specific surface area of 32,000 $cm^2/g$ was used as the composition (B). As a result, a stretched laminated resin film having a whiteness of 97%, an opacity of 88%, a void content of 38%, a smoothness of 1,400 sec. (layer (B)) and a gloss of 20% (layer (B)) was obtained. An image-receiving sheet for melt thermal transfer recording was prepared from this film as a support layer.

Comparative Example 8

The procedure of Example 3 was followed to obtain an image-receiving sheet for melt thermal transfer recording, except that the primer (II) was not applied.

Comparative Example 9

The procedure of Example 3 was followed to obtain an image-receiving sheet for melt thermal transfer recording, except that a kraft paper having a thickness of 300 μm (Taber stiffness: 90 g·f·cm; weight: 289 $g/m^2$) was used as the laminated pulp paper.

Comparative Example 10

The procedure of Example 1 was followed, except that a composition comprising 50 wt % polypropylene and 50 wt % heavy calcium carbonate having an average grain diameter of 1.5 μm and a specific surface area of 15,000 $cm^2/g$ was used as the composition (B). The support thus obtained was used to prepare an image-receiving sheet for melt thermal transfer recording.

The evaluation results of these image-receiving sheets for melt thermal transfer recording are set forth in Table 2.

The image-receiving sheet for melt thermal transfer recording according to the present invention is advantageous in that the inorganic fine powder incorporated in the polyolefin resin synthetic paper constituting the support (I) has a large specific area. Furthermore, numerous fine surface cracks which have been developed with these fine powder as nuclei by stretching the polyolefin resin are formed in the surface layer of the support (I). Consequently, water which evaporates from the primer layer when heated by a heat source can escape to the inorganic fine powder and fine cracks. In turn, transfer of the hot-melt ink is not inhibited even under high temperature and humidity conditions.

Furthermore, because the inorganic fine powder has a small diameter, the resulting image-receiving sheet has a smooth surface which provides good adhesion to the ink ribbon and good transferability, thereby enabling high speed printing.

Moreover, lamination of the pulp paper layer (IV) onto the back side of the support (I) enhances adhesion of the ink ribbon 1 to the image-receiving sheet for melt thermal transfer recording 2 and also stiffens the support, to thereby prevent an air gap from forming between the ink ribbon 1 and the image-receiving sheet for melt thermal transfer recording 2. Accordingly, even a support (I) comprising inorganic fine powder having a relatively small specific surface area exhibits further improvement in receptivity and transferability of the hot-melt ink by laminating a pulp paper on the back side of the support (I). This makes it possible to provide a sharp transferred image even under high temperature and humidity conditions.

While the invention has been described in detail and with reference to specific examples thereof, it will be apparent to one skilled in the art that various changes and modifications can be made therein without departing from the spirit and scope thereof.

What is claimed is:

1. An image-receiving sheet for melt thermal transfer recording, prepared by a process which comprises:

providing a support (I) comprising a substrate layer (A) made of a stretched film having microvoids formed therein, said stretched film of substrate layer (A) is obtained by stretching a propylene resin film comprising a propylene resin in an amount of from 65 to 95% by weight and inorganic fine powder having a specific surface area of from 10,000 to 40,000 $cm^2/g$ and an average grain diameter of from 0.5 to 2.3 μm in an amount of from 5 to 35% by weight, a surface layer (B) made of a stretched propylene film comprising a propylene resin in an amount of from 35 to 65% by weight and inorganic fine powder having a specific surface area of from 25,000 to 300,000 $cm^2/g$ and an average grain diameter of from 0.07 to 0.9 μm in an amount of from 35 to 65% by weight laminated on one side of said substrate layer (A) and a back surface layer (C) made of a stretched propylene film comprising a propylene resin in an amount of from 35 to 90% by weight and inorganic fine powder having a specific surface area of from 10,000 to 40,000 $cm^2/g$ and an average grain diameter of from 0.5 to 2.3 μm in an amount of from 10 to 65% by weight laminated on the opposite side of said substrate layer (A);

applying an aqueous solution of a nitrogen-containing high molecular compound primer on the surface layer (B) side of the support (I) or on both sides of the support (I);

drying the applied material to form one or more primer layers (IIa, IIb); and then laminating a pulp paper layer (IV) having a thickness of from 40 to 250 μm and a Taber stiffness of from 1 to 60 g·f·cm on the back surface layer (C) side of the support (I) via an adhesive layer (III), wherein the nitrogen-containing high molecular compound primer comprises:

(a) a tertiary or quaternary nitrogen-containing acryl polymer;

(b) a polyimine compound selected from the group consisting of polyethyleneimine, poly (ethyleneimine-urea), ethyleneimine adduct of polyamine polyamide, and an alkyl modification, alkenyl modification benzyl modification or alicyclic hydrocarbon modification product thereof in an amount of from 20 to 300 parts by weight per 100 parts by weight of (a); and (c) an epichlorohydrin adduct of polyamine polyamide in an amount of from 20 to 300 parts by weight per 100 parts by weight of (a).

2. The image-receiving sheet for melt thermal transfer recording according to claim 1, wherein said inorganic fine powder contained in said surface layer (B) comprises a heavy calcium carbonate having a specific surface area of from 25,000 to 40,000 $cm^2/g$ and an average grain diameter of from 0.5 to 0.9 μm.

3. The image-receiving sheet for melt thermal transfer recording according to claim 1, wherein said inorganic fine powder contained in said surface layer (B) comprises colloidal calcium carbonate fine powder having a specific surface area of from 40,000 to 300,000 $cm^2/g$ and an average grain diameter of from 0.07 to 0.5 μm.

4. The image-receiving sheet for melt thermal transfer recording according to claim 1, wherein said substrate layer (A) is biaxially stretched.

5. The image-receiving sheet for melt thermal transfer recording according to claim 1, wherein said microvoids are oval microvoids having a size of from 3 to 20 μm.

6. The image-receiving sheet for melt thermal transfer recording according to claim 1, wherein said surface layer (B) and said back surface layer (C) are uniaxially or biaxially stretched.

7. The image-receiving sheet for melt thermal transfer recording according to claim 1, wherein said propylene resin comprises a propylene homopolymer or a propylene-α-olefin copolymer.

8. The image-receiving sheet for melt thermal transfer recording according to claim 1, wherein the support (I) has a void content of from 20 to 60%.

9. The image-receiving sheet for melt thermal transfer recording according to claim 1, wherein the support (I) has a thickness of from 40 to 300 μm.

10. The image-receiving sheet for melt thermal transfer recording according to claim 1, wherein said nitrogen-containing high molecular compound primer further comprises a water soluble inorganic salt in an amount of 5 to 20 parts by weight per 100 parts by weight of (a).

11. An image-receiving sheet for melt thermal transfer recording, comprising:

a support (I) comprising (i) a substrate layer (A) made of a stretched film having microvoids formed therein, said stretched film of substrate layer (A) comprising a propylene resin in an amount of from 65 to 95% by weight and inorganic fine powder having a specific surface area of from 10,000 to 40,000 $cm^2/g$ and an average grain diameter of from 0.5 to 2.3 μm in an amount of from 5 to 35% by weight, (ii) a surface layer (B) made of a stretched propylene film comprising a propylene resin in an amount of from 35 to 65% by weight and inorganic fine powder having a specific surface area of from 25,000 to 300,000 $cm^2/g$ and an average grain diameter of from 0.07 to 0.9 μm in an amount of from 35 to 65% by weight laminated on one side of said substrate layer (A) and (iii) a back surface layer (C) made of a stretched propylene film comprising a propylene resin in an amount of from 35 to 90% by weight and inorganic fine powder having a specific surface area of from 10,000 to 40,000 $cm^2/g$ and an average grain diameter of from 0.5 to 2.3 μm in an amount of from 10 to 65% by weight laminated on the opposite side of said substrate layer (A);

a water-soluble primer layer (IIa, IIb) coated on the surface layer (B) side of the support (I) or on both sides of the support (I); and a pulp paper layer (IV) having a thickness of from 40 to 250 μm and a Taber stiffness of from 1 to 60 g·f·cm laminated on the back surface layer (C) side of the support (I).

12. The image-receiving sheet for melt thermal transfer recording according to claim 11, further comprising an adhesive layer (III) disposed between said pulp paper layer (IV) and the back surface layer (C) side of the support (I).

13. The image-receiving sheet for melt thermal transfer recording according to claim 11, wherein a water-soluble primer layer (IIa, IIb) is coated on both sides of the support (I).

14. The image-receiving sheet for melt thermal transfer recording according to claim 11, wherein said water-soluble primer layer (IIa, IIb) is a nitrogen-containing high molecular compound primer layer comprising:

(a) a tertiary or quaternary nitrogen-containing acryl polymer;

(b) a polyimine compound selected from the group consisting of polyethyleneimine, poly(ethyleneimine-urea), ethyleneimine adduct of polyamine polyamide, and an alkyl modification, alkenyl modification benzyl modification or alicyclic hydrocarbon modification product thereof in an amount of from 20 to 300 parts by weight per 100 parts by weight of (a); and (c) an epichlorohydrin adduct of polyamine polyamide in an amount of from 20 to 300 parts by weight per 100 parts by weight of (a).

15. The image-receiving sheet for melt thermal transfer recording according to claim 11, wherein said inorganic fine powder contained in said surface layer (B) comprises a heavy calcium carbonate having a specific surface area of from 25,000 to 40,000 $cm^2/g$ and an average grain diameter of from 0.5 to 0.9 μm.

16. The image-receiving sheet for melt thermal transfer recording according to claim 11, wherein said inorganic fine powder contained in said surface layer (B) comprises colloidal calcium carbonate fine powder having a specific surface area of from 40,000 to 300,000 $cm^2/g$ and an average grain diameter of from 0.07 to 0.5 μm.

17. The image-receiving sheet for melt thermal transfer recording according to claim 11, wherein said substrate layer (A) is biaxially stretched and said layer (B) and said back surface layer (C) are uniaxially or biaxially stretched.

18. The image-receiving sheet for melt thermal transfer recording according to claim 11, wherein said microvoids are oval microvoids having a size of from 3 to 20 μm.

19. The image-receiving sheet for melt thermal transfer recording according to claim 11, wherein said propylene resin comprises a propylene homopolymer or a propylene-α-olefin copolymer.

20. The image-receiving sheet for melt thermal transfer recording according to claim 11, wherein the support (I) has a void content of from 20 to 60%.

21. The image-receiving sheet for melt thermal transfer recording according to claim 11, wherein the support (I) has a thickness of from 40 to 300 μm.

* * * * *